US012403389B2

(12) United States Patent
Bhavsar

(10) Patent No.: US 12,403,389 B2
(45) Date of Patent: Sep. 2, 2025

(54) 3D PUZZLES WITH REPLACEABLE TILES

(71) Applicant: Harshad Bhavsar, Boston, MA (US)

(72) Inventor: Harshad Bhavsar, Boston, MA (US)

( * ) Notice: Subject to any disclaimer, the term of this patent is extended or adjusted under 35 U.S.C. 154(b) by 0 days.

(21) Appl. No.: 18/414,598

(22) Filed: Jan. 17, 2024

(65) Prior Publication Data

US 2024/0238668 A1 Jul. 18, 2024

Related U.S. Application Data

(60) Provisional application No. 63/480,247, filed on Jan. 17, 2023.

(51) Int. Cl.
*A63F 9/08* (2006.01)

(52) U.S. Cl.
CPC .... *A63F 9/0842* (2013.01); *A63F 2009/0849* (2013.01)

(58) Field of Classification Search
CPC ..... A63F 9/0842; A63F 2009/0849; A63F 9/0826
See application file for complete search history.

(56) References Cited

U.S. PATENT DOCUMENTS 3,565,442 A 2/1971 Burton
3,608,906 A * 9/1971 Odier ..... A63F 9/12 446/85
4,403,776 A 9/1983 Subotics et al.
4,407,502 A 10/1983 Paulos
4,409,750 A * 10/1983 Silbermintz ..... A63F 9/0842 40/107
4,416,453 A * 11/1983 Sasso ..... A63F 9/0838 273/153 S
4,437,667 A * 3/1984 Miller ..... A63F 9/0842 273/272
4,529,201 A 7/1985 Nadel
4,558,866 A 12/1985 Alford
4,715,605 A 12/1987 Fritzman
4,741,534 A 5/1988 Rogahn
5,074,561 A 12/1991 Johnson
5,785,319 A 7/1998 Frauhiger
6,422,560 B1 7/2002 Harbaugh
(Continued)

FOREIGN PATENT DOCUMENTS

CN 102824744 A 12/2012
DE 3131654 A1 2/1983
(Continued)

OTHER PUBLICATIONS

Rubik's America, <https://www.rubiks.com/en-us/> retrieved on Feb. 22, 2021, 6 pages.

*Primary Examiner* — Steven B Wong
(74) *Attorney, Agent, or Firm* — Lathrop GPM LLP; Tucker Griffith

(57) ABSTRACT

A logic cube with changeable tiles is presented. The tiles which can be fit on the logic cube, have indicia in well-defined positions and orientations such that the resulting solid is an exact but larger replica of the initial logic cube. The tiles are such that they can be easily fit or removed, and do not fall off with the movement of the logic cube. They also do not obstruct the functionality of the logic cube. Other geometric shapes such as tetrahedron and dodecahedron and sizes other than 3×3×3 may be used.

19 Claims, 3 Drawing Sheets

(56) References Cited

U.S. PATENT DOCUMENTS

| | | | | |
|---|---|---|---|---|
| 6,513,808 | B2 | 2/2003 | Fang | |
| D528,607 | S | 9/2006 | Sugden | |
| 7,100,917 | B2 | 9/2006 | Wang | |
| 7,600,756 | B2 | 10/2009 | Verdes | |
| 7,644,924 | B2 | 1/2010 | Horowitz | |
| D655,762 | S | 3/2012 | Munasur | |
| D705,366 | S | 5/2014 | Inversin | |
| 10,543,421 | B1 | 1/2020 | Smith | |
| 10,765,932 | B1 * | 9/2020 | Tsai | A63F 7/042 |
| 11,000,772 | B2 * | 5/2021 | Osipov | A63F 13/24 |
| 2002/0180149 | A1 | 12/2002 | Possidento | |
| 2006/0033271 | A1 * | 2/2006 | Wu | A63F 9/12 273/153 R |
| 2006/0163810 | A1 * | 7/2006 | Wang | A63F 9/0842 273/153 S |
| 2007/0267813 | A1 | 11/2007 | Horowitz | |
| 2008/0303211 | A1 | 12/2008 | La | |
| 2010/0084814 | A1 * | 4/2010 | Yang | A63F 9/1204 273/153 S |
| 2010/0259001 | A1 * | 10/2010 | Muller, III | A63F 9/0842 273/153 S |
| 2012/0302303 | A1 | 11/2012 | Rosendo | |
| 2018/0361228 | A1 * | 12/2018 | Paz | A63F 9/12 |
| 2022/0032171 | A1 * | 2/2022 | Bhavsar | A63F 9/0842 |
| 2022/0293011 | A1 * | 9/2022 | Ko | G09B 19/0053 |

FOREIGN PATENT DOCUMENTS

| | | | | |
|---|---|---|---|---|
| DE | 102013016153 | B3 | 1/2015 | |
| FR | 2507490 | A1 * | 12/1982 | |
| GB | 2573488 | A | 11/2019 | |
| KR | 2019000277 | U | 1/2019 | |
| KR | 2019023391 | A | 3/2019 | |
| KR | 20210127314 | A * | 10/2021 | |
| KR | 102696799 | B1 * | 8/2024 | |
| WO | WO-2011119212 | A2 * | 9/2011 | A63F 9/0842 |
| WO | WO-2015043999 | A1 * | 4/2015 | A63F 9/0842 |
| WO | WO-2017132708 | A1 * | 8/2017 | A63F 9/0842 |

* cited by examiner

Center Tile Top View

Center Tile
Front View

Center Tile Side
View

Fig 3A Edge Tile
Top View

Edge Tile
Front View

Edge Tile Side
View

Corner Tile
Top View

Corner Tile
Front View

Corner Tile
Side View

3D PUZZLES WITH REPLACEABLE TILES

STATEMENT OF RELATED INVENTIONS

This application is a U.S. Nonprovisional application which claims the benefit of U.S. Provisional Application No. 63/480,247, filed Jan. 17, 2023, and is hereby incorporated by reference in its entirety.

BACKGROUND

Various embodiments relate generally to logic cubes and, more specifically, relate to logic cubes with changeable tiles.

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Three-dimensional (3D) puzzles such as Rubik's Cubes have existed for many years now. These puzzles may have flat or slightly curved surfaces. The primary objective of these puzzles to rearrange the visible small squares purely based on the functionality of the logic cube, so that all the small squares of the same color appear on every face. There are no other easy ways to move the visible surfaces. Creations such Lego cubes to some extent allow this movement, however the resulting solid does not remain a perfect cube. Moreover, if the smaller squares were to have added features and functions then the Lego of the Lego cube lack the specificity around position and orientation.

Additional features of logic cubes are described in "Meaningful combination generating logic cube", U.S. Patent Publication No. 2022/0032171, filed Jul. 30, 2020, which is hereby incorporated by reference in its entirety.

SUMMARY

The below summary is merely representative and non-limiting.

The above problems are overcome, and other advantages may be realized, by the use of the embodiments.

In a first aspect, an embodiment provides a 3D puzzle which can be modified by adding tiles to the puzzle with the purpose of customization while keeping the shape of the original puzzle and not compromising the movement of the puzzle. This 3D puzzle includes a structural design for the internal operating mechanism as well as the tiles which can be added to the operating mechanism such that a) the resulting solid remains a perfect cube b) there are no obstructions to the functionality of the logic cube c) each tile can be easily fit and removed d) each tile has a specific position and orientation.

BRIEF DESCRIPTION OF THE DRAWINGS

Aspects of the described embodiments are more evident in the following description, when read in conjunction with the attached Figures.

FIG. 3A is an illustrated top view of an edge tile.

DETAILED DESCRIPTION

Figure 1:
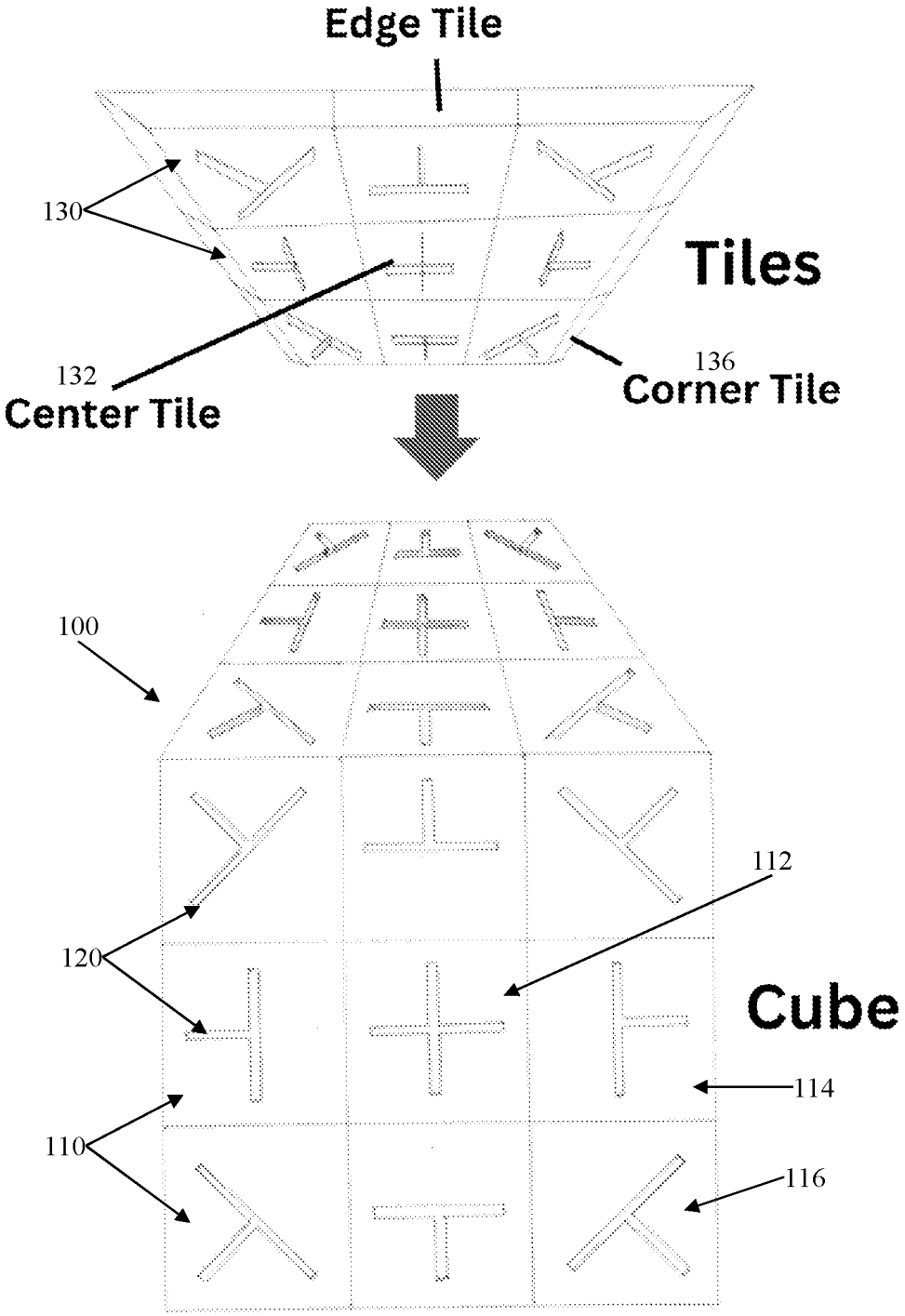
FIG. 1 is an illustrated view of a modified logic cube along with the tiles showing how different types of tiles can be added specific to predefined positions and orientations

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

References to fitting tiles on the cube in the following paragraph are similar to inserting a three pin plug into a three ping socket where a three pin plug can be inserted in a specific orientation and specific direction with little or no effort and removed with little or no effort in the opposite direction, also the plug remaining firmly in its position when forces in any other direction are applied.

FIG. 1 shows a three-dimensional solid 100 with three (3) layers across three (3) axes thereby representing a 3×3×3 cube. The visible surfaces of this cube 100 have cutout like structures 120 on each small square 110 so as to allow specific type of tile 130 to be fit in specific configurations. In the same FIG. 1, the top part shows the different types of tiles 130, their arrangement along one face and how they will fit in the cube 100.

The smaller cubes 110 of the larger cube 100 can be differentiated into three categories: a) Center cube with only (1) one face visible b) Edge cube 114 with (2) two faces visible and c) Corner cube 116 with (3) three faces visible.

Similarly, the tiles 130 that can be fit on the visible faces of the smaller cubes 110 correspondingly can be differentiated into a) Center Tile 132 to fit on Center cube face 112 with (4) four different orientations b) Edge Tile 134 to fit on Edge cube 114 with exactly (1) orientation and c) Corner Tile 136 to fit on the Corner cube face 116 with exactly (1) orientation.

Figure 2A:
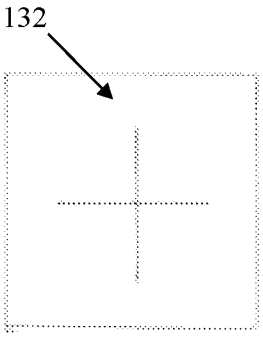
FIG. 2A is an illustrated top view of a center tile.
Figure 2B:
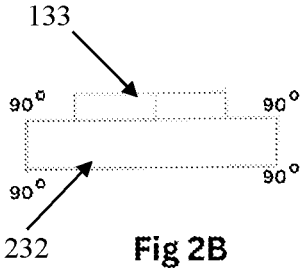
FIG. 2B is an illustrated front view of the center tile.
Figure 2C:
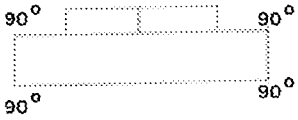
FIG. 2C is an illustrated side view of the center tile.

As showing in FIGS. 2A, 2B and 2C, the base of the Center Tile 132 has all surfaces mutually perpendicular to each other. The smallest dimension of the base 232 is the width of the tile consistent with the width of the Edge Tile 134 and Corner Tile 136, whereas the other two dimensions of the base 232 are exactly same as the side of the smaller cube 110. On top of the base 232, there is a (+) plus shaped structure 133 which fits in the cutout like structure 120 of the Center cube 112.

Figure 3B:
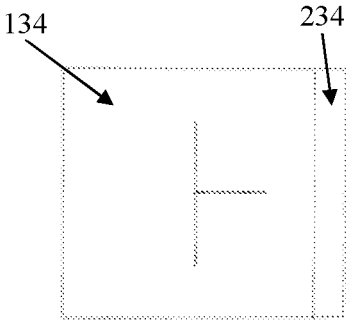
FIG. 3B is an illustrated front view of the edge tile.
Figure 3B:
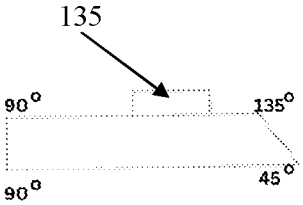
Figure 3C:
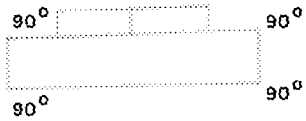
FIG. 3C is an illustrated side view of the edge tile.

As showing in FIGS. 3A, 3B and 3C, the base of the Edge Tile 134 has all surfaces mutually perpendicular to each other, except one 234. The smallest dimension of the base is the width of the tile 134 consistent with the width of the Center Tile 132 and Corner Tile. On top of the base, there is a Ts shaped structure 135 which fits in the cutout like structure 120 of the Edge cube 114. The surface of the Edge Tile 134 to which the T structure 135 is attached is a square with same dimensions as that of the smaller cubes 110. The opposite surface is a rectangle with short side having the length of the smaller cube 110 and long side having the length equivalent to the sum of length of the smaller cube 110 and the width of the tile.

Figures 4A, 4B, 4C:
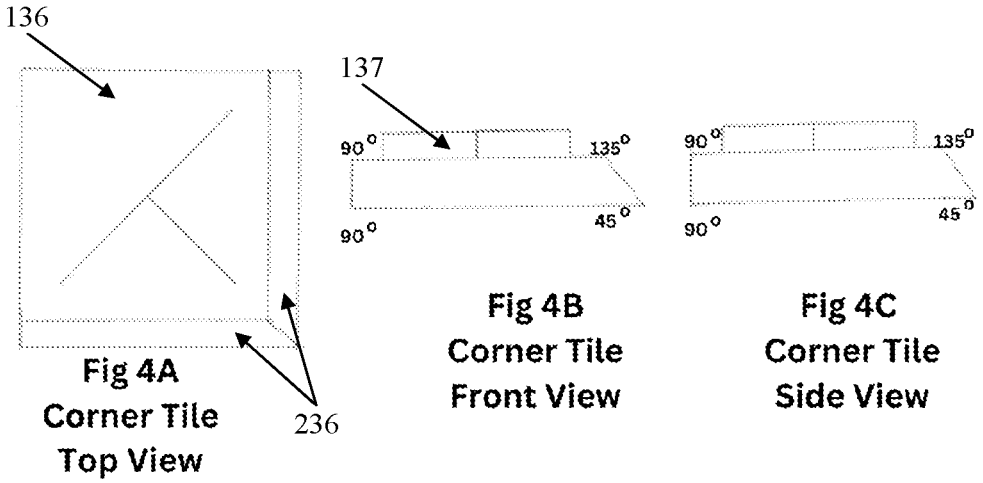
FIG. 4A is an illustrated top view of a corner tile.
FIG. 4B is an illustrated front view of the corner tile.
FIG. 4C is an illustrated side view of the corner tile.

As showing in FIGS. 4A, 4B and 4C, the base of the Corner Tile 136 has all surfaces mutually perpendicular to each other, except two 236. The smallest dimension of the base is the width of the tile 136 consistent with the width of the Center Tile 132 and Edge Tile 134. On top of the base, there is a Ts shaped structure 137 which fits in the cutout like structure 120 of the Corner cube 116. The surface of the Corner Tile 136 to which the T structure 137 is attached is a square with same dimensions as that of the smaller cube 110. The opposite surface is also a square with sides having the length equivalent to the sum of length of the smaller cube 110 and the width of the tile 136.

A tile 130 could be applied to the smallest shape on each face of a three-dimensional logic solid. For example, a 3×3×3 logic cube would have 9 times 6 equals 54 square tiles. Other logic solids may have 60 rhombus tiles, 60 trapezium tiles and 12 pentagon tiles, for example.

The tiles 130 are such that after all of them are fit on the initial solid 100, the new solid looks exactly similar but larger to the initial solid 100. For example, after fitting all the tiles 130 on a 3×3×3 logic cube 100, the new solid will look exactly like a cube with no gaps at the edges or corners. The cube formed after fitting all the tiles 130 has sides greater than the original cube by twice the width of the tiles.

The structural design of the tiles 130 is such that after fitting all of them on the three-dimensional logic solid 100, the function and movement of the three-dimensional logic solid 100 is not impacted and the tiles 130 do not obstruct any previously available movement.

For certain three-dimensional logic solids the proportion between different layers or faces change after all the tiles are fitted. In such scenarios, a three-dimensional logic solid with alternate but specific dimensions is such that after all the tiles are fit, the proportions between different layers or faces is as desired. In case of the cube, the center cube will have sides greater than the corner cube by twice the width of the tile. The edge cube will have shorter side equivalent to the side of the corner cube and longer side equivalent to the side of the center cube.

Tiles can have indicia in the form of text, numbers and pictures so that functionally along with all the other tiles, they work as a predetermined system. Tiles can also allow a player to write and erase. The indicia can also be three-dimensional.

The tiles can be used to create various systems with various objectives. These include groupings of n tiles to create meaningful combinations, Venn diagrams, puzzles such as Sudoku and crosswords, board games such as chess, two- and three-dimensional mazes and special applications such as Braille writing.

The design of the tiles can be derived for any n×n×n solid as well as for different three-dimensional shapes such as a cube, tetrahedron, and dodecahedron and so on.

In some embodiments, the tiles 130 may be secured to the smaller cubes 110 using close-fit features, such as structures 133, 135, 137 and cutout like structures 120. In further embodiments, the tiles 130 may connect using magnets, adhesives, hook-and-loop fasteners and/or other structures (such as peg and hole, tongue and groove, etc.).

In various embodiments, the outer face of the tiles 130 (opposite the face connected to the small cube 110) may include various features. This may include permanent stickers (e.g., colored patters, pieces of images, etc.), structures (e.g., Braille writing), etc.

Various embodiments provide, a logic puzzle. The logic puzzle includes a first geometric solid (such as the cube 100) having a first predetermined number of visible outer faces (if the first geometric solid is a cube, this would be 6). The first geometric solid includes a plurality of second geometric solids. The second geometric solids each have a second predetermined number of visible outer surfaces (such as small squares 110). The second geometric solids are rotatable within the first geometric solid such that at least one visible outer surface of each second geometric solid includes a portion of one of the faces of the first geometric solid for at least one rotatable orientation of the plurality of second geometric solids within the first geometric solid.

The logic puzzle also includes at least one tile configured to be fit on at least one outer surface of the second geometric solid such that the tile can be removably secured during the function of the first geometric solid. The tile does not obstruct the movement and function of the first geometric solid when fit on the at least one outer surface of the second geometric solid.

In a further embodiment of the logic puzzle above, the second geometric solid within the first large geometric solid comprises: a center solid having one outer face, an edge solid having two outer faces, and a corner solid having three outer faces. A center tile fits on the outer surface of the center solid. An edge tile fits on the outer surface of the edge solid and a corner tile fits on the outer surface of the corner solid.

In another embodiment of any one of the logic puzzles above, the puzzle also includes a two-dimensional indicia disposed on the at least one tile.

In a further embodiment of any one of the logic puzzles above, a larger version of the first geometric solid is created after all of the at least one tiles are fit on the at least one outer surface of the second geometric solid.

In another embodiment of any one of the logic puzzles above, a pattern is created by a plurality of indicia on the at least one tiles, and each of the indicia are coupled to an indicia on another tile. A meaningful expression on the at least one tiles may be created by the collection of the indicia. The pattern of the indicia on the at least one tiles may have a desired orientation that stays true after any numbers of moves/rotations of the layers of the first large geometric solid. The indicia on the at least one tiles may include text in one or more languages; numbers in one or more arithmetic formats; a pictorial or symbolic image; or form Venn Diagrams. The indicia on the at least one tiles can be three-dimensional and/or include Braille script. The indicia on the at least one tiles can form a three-dimensional puzzle or maze.

In a further embodiment of any one of the logic puzzles above, the at least one tiles include a dry erase surface.

In another embodiment of any one of the logic puzzles above, the first geometric solid includes at least three rotatable layers along each axis.

In a further embodiment of any one of the logic puzzles above, the geometric solid has a shape that is a cube, tetrahedron or dodecahedron.

The foregoing description has been directed to particular embodiments. However, other variations and modifications may be made to the described embodiments, with the attainment of some or all of their advantages. Modifications to the above-described systems and methods may be made without departing from the concepts disclosed herein. Accordingly, the invention should not be viewed as limited by the disclosed embodiments. Furthermore, various features of the described embodiments may be used without the corresponding use of other features. Thus, this description should be read as merely illustrative of various principles, and not in limitation of the invention.

What is claimed is:

1. A logic puzzle comprising:

a first geometric solid having a first predetermined number of visible outer faces, the first geometric solid comprising a plurality of second geometric solids, the plurality of second geometric solids each having a second predetermined number of visible outer surfaces and each visible outer surface having a corresponding cutout structure of a plurality of cutout structures;

the second geometric solids each being rotatable within the first geometric solid such that at least one visible outer surface of each second geometric solid comprises a portion of one of the faces of the first geometric solid for at least one rotatable orientation of the plurality of second geometric solids within the first geometric solid; and at least one tile configured to be fit in a target orientation on the at least one visible outer surface of the second geometric solid such that the tile can be removably secured during the function of the first geometric solid, wherein the at least one tile has a corresponding shaped structure of a plurality of shaped structures which fits in the corresponding cutout structure of the second geometric solid to orient the at least one tile in the target orientation, wherein each cutout structure of the plurality of cutout structures has a cutout shape distinct from each other and each shaped structure of the plurality of shaped structures has a shape distinct from each other, and wherein the at least one tile is further configured to not obstruct the movement and function of the first geometric solid when fit on the at least one outer surface of the second geometric solid.

2. The logic puzzle of claim 1, wherein the second geometric solid within the first large geometric solid comprises:

a center solid having one outer face, an edge solid having two outer faces, and a corner solid having three outer faces.

3. The logic puzzle of claim 2, wherein:

a center tile is configured to be fit on the outer surface of the center solid, an edge tile is configured to be fit on the outer surface of the edge solid and a corner tile is configured to be fit on the outer surface of the corner solid.

4. The logic puzzle of claim 1, further comprising a two-dimensional indicia disposed on the at least one tile.

5. The logic puzzle of claim 1, wherein a larger version of the first geometric solid is created after all of the at least one tiles are fit on the at least one outer surface of the second geometric solid.

6. The logic puzzle of claim 1, wherein a pattern is created by a plurality of indicia on the at least one tiles, and each of the indicia are coupled to an indicia on another tile.

7. The logic puzzle of claim 6, wherein a meaningful expression on the at least one tiles is created by collection of the indicia.

8. The logic puzzle of claim 6, wherein the pattern of the indicia on the at least one tiles has a desired orientation that stays true after any numbers of moves/rotations of the layers of the first large geometric solid.

9. The logic puzzle of claim 6, wherein the indicia on the at least one tiles comprises text in one or more languages.

10. The logic puzzle of claim 6, wherein the indicia on the at least one tiles comprises numbers in one or more arithmetic formats.

11. The logic puzzle of claim 6, wherein the indicia on the at least one tiles comprises a pictorial or symbolic image.

12. The logic puzzle of claim 6, wherein the indicia on the at least one tiles form Venn Diagrams.

13. The logic puzzle of claim 6, wherein the indicia on the at least one tiles is three-dimensional.

14. The logic puzzle of claim 6, wherein the indicia on the at least one tiles comprises Braille script.

15. The logic puzzle of claim 6, wherein the plurality of indicia comprises elevations and ridges forming a three-dimensional maze.

16. The logic puzzle of claim 1, wherein the at least one tiles comprise a dry erase surface.

17. The logic puzzle of claim 1, wherein the first geometric solid comprises at least three rotatable layers along each axis.

18. The logic puzzle of claim 1, wherein the geometric solid has a shape that is one of:

cube, tetrahedron and dodecahedron.

19. The logic puzzle of claim 1, wherein a subset of visible outer surfaces has the same cutout structure and a subset of tiles has the same shaped structure.

* * * * *